US006568793B2

(12) United States Patent
Santhanam et al.

(10) Patent No.: US 6,568,793 B2
(45) Date of Patent: May 27, 2003

(54) MULTIPLE BIT MATRIX CONFIGURATION FOR KEY-LATCHED PRINTHEADS

(75) Inventors: Ram Santhanam, San Diego, CA (US); Marcus Scholz, San Diego, CA (US); Junji Yamamoto, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/845,074

(22) Filed: Apr. 27, 2001

(65) Prior Publication Data

US 2002/0041314 A1 Apr. 11, 2002

Related U.S. Application Data

(62) Division of application No. 09/477,940, filed on Jan. 5, 2000, now Pat. No. 6,290,346.

(51) Int. Cl.[7] ..... B41J 2/01
(52) U.S. Cl. ..... 347/50
(58) Field of Search ..... 347/50, 49, 85, 347/86, 87, 39

(56) References Cited

U.S. PATENT DOCUMENTS

| | | | | |
|---|---|---|---|---|
| 4,853,708 A | | 8/1989 | Walters | 347/86 |
| 5,519,422 A | * | 5/1996 | Thoman et al. | 347/49 |
| 5,870,113 A | | 2/1999 | Koizumi | 347/14 |
| 6,130,695 A | * | 10/2000 | Childers et al. | 347/85 |
| 6,161,920 A | * | 12/2000 | Santhanam et al. | 347/50 |
| D439,925 S | * | 4/2001 | Santhanam et al. | D18/56 |
| 6,227,663 B1 | * | 5/2001 | Santhanam et al. | 347/87 |
| 6,290,346 B1 | * | 9/2001 | Santhanam et al. | 347/86 |
| 6,290,348 B1 | * | 9/2001 | Becker et al. | 347/87 |
| 6,293,718 B1 | * | 9/2001 | Osmus | 400/625 |
| 6,296,345 B1 | * | 10/2001 | Kline et al. | 347/49 |
| 6,332,676 B1 | * | 12/2001 | Santhanam | 347/86 |
| 6,471,626 B1 | * | 10/2002 | Shepherd et al. | 400/323 |
| 6,499,826 B1 | * | 12/2002 | Kline et al. | 347/37 |
| 2002/0003553 A1 | * | 1/2002 | Ng | 347/22 |

FOREIGN PATENT DOCUMENTS

| | | |
|---|---|---|
| EP | 0812693 A1 | 12/1997 |
| EP | 0816098 A2 | 1/1998 |

* cited by examiner

*Primary Examiner*—Michael Nghiem

(57) ABSTRACT

A carriage assembly for holding one or more inkjet print cartridges. A mechanical key on a carriage chute is formed in a predetermined pattern having a plurality of columns such that at least one of the columns acts as a barrier preventing a non-compatible print cartridge from staying in a secured mounting position.

21 Claims, 15 Drawing Sheets

SINGLE COLUMN LOCKOUT

SINGLE COLUMN LOCKOUT

SUBSET UNIVERSAL PRINT CARTRIDGE KEY

SUBSET UNIVERSAL PRINT CARTRIDGE KEY

SUBSET UNIVERSAL PRINT CARTRIDGE KEY

HEX COLUMN MATCHUP

SINGLE COLUMN LOCKOUT

MULTIPLE BIT MATRIX CONFIGURATION FOR KEY-LATCHED PRINTHEADS

CROSS REFERENCE TO RELATED APPLICATIONS

This is a continuation of application Ser. No. 09/477,940 filed on Jan. 5, 2000 now U.S. Pat. No. 6,290,346.

RELATED APPLICATIONS

This application is related to the following copending utility patent applications, each filed concurrently on Jan. 5, 2000: Ser. No. 09/477,645 by Ram Santhanam et al., entitled "Vent For An Ink-Jet Print Cartridge;" Ser. No. 09/477,646 by Ram Santhanam et al., entitled "Ink-Jet Printer Cartridge Having A Low Profile;" Ser. No. 09/477,644 by Junji Yamamoto et al., entitled "Horizontally Loadable Carriage For An Ink-Jet Printer;" Ser. No. 09/477,649 by Junji Yamamoto et al., entitled "Method And Apparatus For Horizontally Loading And Unloading An Ink-Jet Print Cartridge From A Carriage;" Ser. No. 09/478,148 by Richard A. Becker et al., entitled "Techniques For Providing Ink-Jet Cartridges With A Universal Body Structure;" Ser. No. 09/477,843, now U.S. Pat. No. 6,161,920 by Ram Santhanam et al., entitled "Techniques For Adapting A Small Form Factor Ink-Jet Cartridge For Use In A Carriage Sized For A Large Form Factor Carriage;" Ser. No. 09/478,190 by James M. Osmus, entitled "Printer With A Two Roller, Two Motor Paper Delivery System;" Ser. No. 09/477,860 by Keng Leong Ng, entitled "Low Height Inkjet Service Station;" Ser. No. 09/477,648 by Matt Shepherd et al., entitled "New Method Of Propelling An Inkjet Printer Carriage;" and Ser. No. 29/116,564, now U.S. Pat. No. D439,925 by Ram Santhanam et al., entitled "Ink Jet Print Cartridge."

BACKGROUND OF THE INVENTION

This invention relates generally to print cartridges mountable on printer carriages, and more specifically to mechanical techniques for preventing inkjet print cartridges from being used with non-compatible printers.

The ability to ship and store print cartridges prior to installation on a printer has many benefits to the manufacturer, distributor and user. Similarly the life of a printer can be extended by providing removable print cartridges as well as replaceable print cartridges. However, the proliferation of such removable and replaceable print cartridges has created many problems arising from inadvertent use of similar appearing print cartridges in non-compatible printer carriages.

Moreover the use of different types of inks, print media, and product implementations (facsimile machines, monochrome printers, color printers, copiers, multiple-function printers/fax/copiers, single chute carriages for holding different types of print cartridges, multiple chute carriages, cartridges capable of carriage refill, cartridges capable of periodic on-carriage ink replenishment, continuous on-carriage ink replenishment systems) has created the need to differentiate between similar appearing print cartridges which have different intended uses.

The problems of maintenance and warranty have also become aggravated when similar appearing print cartridges have been customized under joint development agreements for different end use implementations, some of which require mounting on standard carriages which move across a print zone while others are mounted alone or in groups on stationary carriages. Value added resellers want assurances that general use print cartridges outside of their control cannot be inadvertently used in their customized printing systems. In order to be able to provide some guarantee of quality, availability, warranty, maintenance and support, there is a growing need to uniquely identify print cartridges as well as to uniquely identify printer carriages and individual carriage chutes in a simple mechanical way. Electronic identification systems tend to be more expensive and are sometimes less reliable than mechanical encoding systems.

Conventional label identification systems are extensively used but are often ignored by users and distributors, and even high visibility color coding of print cartridges has not provided satisfactory results.

A prior mechanical technique is described in U.S. Pat. No. 5,519,422 entitled METHOD AND DEVICE FOR PREVENTING UNINTENDED USE OF PRINT CARTRIDGES wherein a first level tab system controls initial insertion of a print cartridge, and a second level barrier system controls a final mounting step into a printer carriage. The implementation required different customized mechanical parts on two separate portions of the print cartridge as well as two corresponding separate portions of a carriage chute. Also there was a risk of tampering with the first level tabs by breaking them off in order to alter the ID system.

Another prior mechanical technique has been employed by Lexmark which uses a rudimentary dual system where a large upstanding cap extending about one and one/half centimeters above the print cartridge has a central convex protrusion for one group of cartridges used in Xerox and Compaq printers and a central concave recess for another group of cartridges used in Lexmark printers. A second level of identification is provided with a pair of equally spaced apart narrow slots on the Xerox and Compaq print cartridges which are respectively located at different lateral positions relative to the central convex protrusion. Very few combinations are possible with this system, and it requires excessive space on both the print cartridge and the carriage.

DETAILED DESCRIPTION OF PREFERRED EMBODIMENTS

The present invention provides many combinations of ID for print cartridges and corresponding printer carriages and individual carriage chutes. A low profile pattern of columns which form a multiple bit matrix configuration is provided on a print cartridge and on its corresponding carriage. The columns are positioned to be contiguous for efficient use of space, and are capable of different lengths as measured from a default position.

One embodiment incorporates separate blocks to define each bit position on a column, while another preferred embodiment provides a continuous contoured edge which moves back and forth depending on the matrix code which identifies a particular family of print cartridges (or carriages) as well as individual print cartridges (or carriages) within each family.

Universal compatibility, family subset compatibility as well as unique one to one compatibility are possible with this multi-bit matrix scheme. The number of combinations can be expanded by either increasing the number of columns and/or by increasing the number of bit positions on a column. In a preferred form of the invention, the corresponding columns achieve complete matchup when the forward boundary of a print cartridge key matrix fits together with the forward boundary of a carriage key matrix.

Compatibility is achieved by limiting the total combined length of one or more particular columns in the carriage and print cartridge key matrices, while lockout is achieved by increasing the total combined length of one or more particular columns in the carriage and print cartridge key matrices. Thus the rationale for achieving various different combinations which allow successful mounting of a print cartridge depends on controlling the pattern of the forward boundary of a key matrix as well as controlling the combined lengths of aligned columns in the carriage and print cartridge matrices.

Unique differentiation between print cartridges is accomplished by having at least one column in a key matrix of a first print cartridge longer than a corresponding column in a key matrix of a second print cartridge.

While the possible number of columns and column lengths (multiple position bits) in theory is endless, implementations in various embodiments of the invention include a five column three bit key matrix, an eight column three bit key matrix separated in the middle by a latch to provide a par of four column three bit key matrices, and a six column four bit key matrix.

Figure 1:
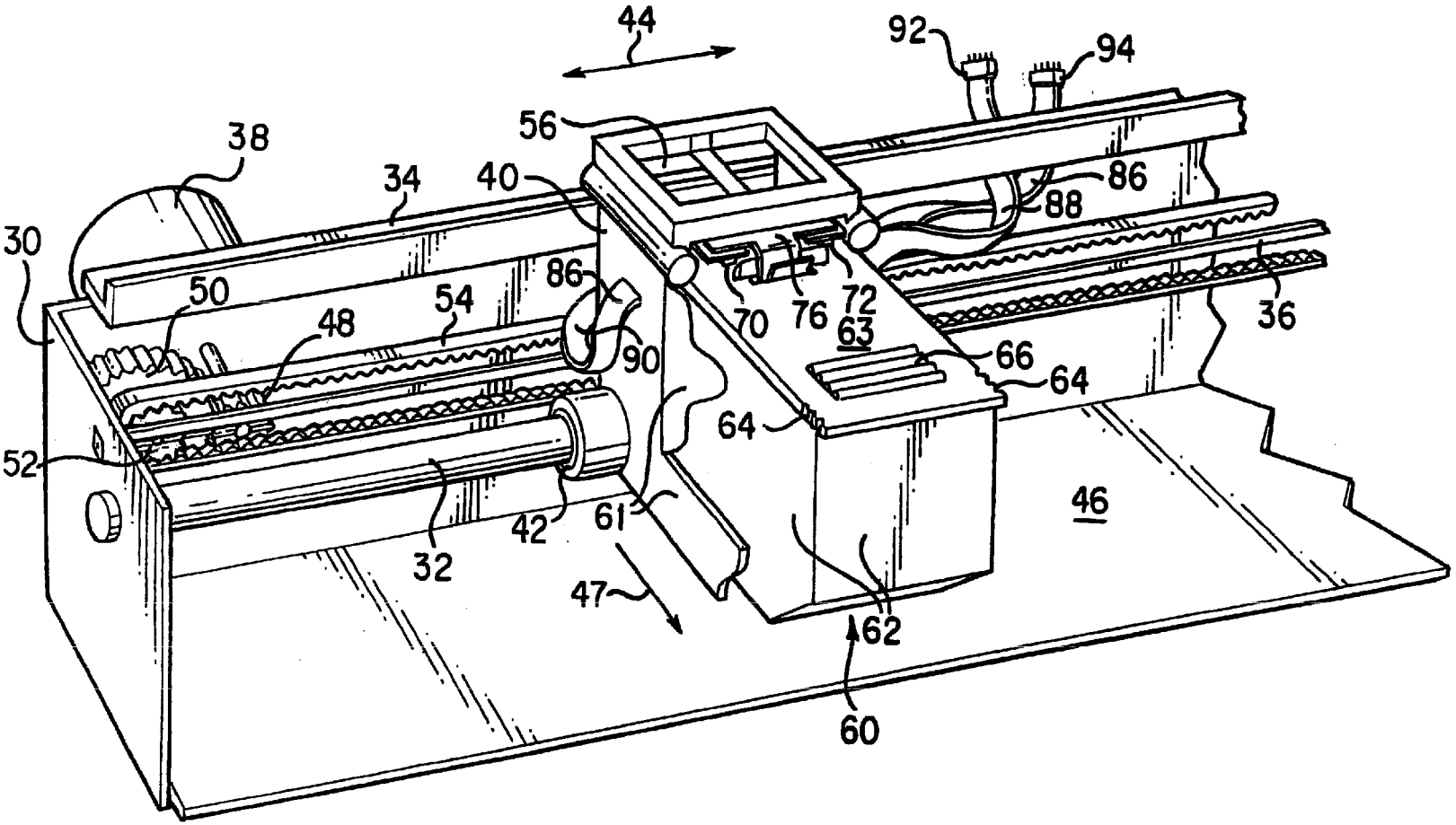
FIG. 1 is a perspective view of a single chute carriage in a printer incorporating an embodiment of the invention, with a print cartridge mounted therein.

An exemplary printing mechanism as shown in FIG. 1 includes a frame 30, support bar 32, angled guide bar 34, encoder strip 36, and carriage drive motor 38. A carriage member 40 has a cylindrical bushing 42 which rides on the support bar 32 back and forth in a carriage scan direction 44 while media is periodically advanced along a platen 46 in a media advance direction 47 through a print zone. The carriage drive motor is mounted on a back of the frame 30 and carries a drive gear 48 coupled through transfer gear 50 to belt gear 52 which engages an inside toothed surface of a carriage drive belt 54. The left end of the encoder strip is cut away to show the details of the carriage drive mechanisms.

In order to facilitate proper positioning of the carriage over the print zone, a guide bracket 56 is attached at the top rear of the carriage member 40 to slide along the angled guide bar 34. A print cartridge 60 is shown mounted on a abbreviated chute 61, and includes a housing 62, and cap member 63 having right and left protruding ribs 64 and laterally extending grooves 66 for manual gripping during installation and removal of the print cartridge from the chute. A nozzle array 67 is located on a bottom surface of the print cartridge for applying ink drops to media on the platen.

The low profile of the cap member is an important feature of the invention (see FIGS. 1 and 4), and the cap includes an upstanding central latch 68 with adjacent key-coded projections 70, 72 that extend only three mm and two mm, respectively, above a top surface of the cap member 63. Space 75 is available on the cap for display of a company trademark or logo. A metal biasing spring 76 extending from the chute presses its V-shaped end 78 downwardly against the central latch 68 and at an angle toward an electrical interconnect 80 on the chute to provide conductive contact with a print cartridge interconnect 82, without causing any interference with the key-coded projections 70, 72.

Figure 2:
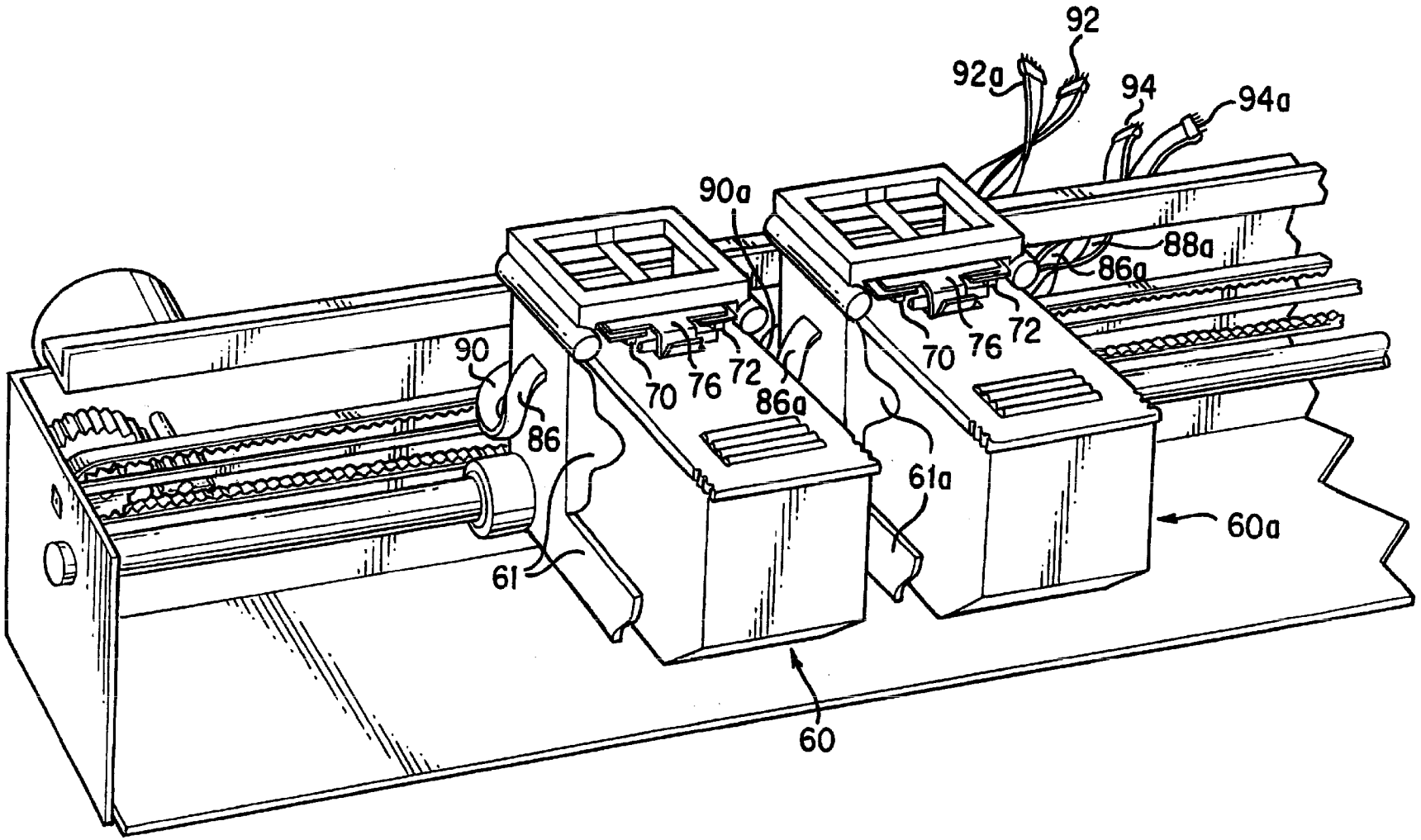
FIG. 2 shows a double chute carriage in the printer of FIG. 1, with two print cartridges mounted therein.

The invention is applicable to single chute carriages (FIG. 1) as well as carriages having additional chutes for holding other identical print cartridges and well as other different types of print cartridges. Traditional carriages holding four print cartridges and high performance carriages holding eight, twelve and more print cartridges can also incorporate the benefits of the invention. A presently preferred embodiment for multiple print cartridges is shown in FIG. 2 with a first tri-compartment print cartridge 60 holding cyan, magenta and yellow ink mounted in chute 61, alongside a black ink print cartridge 60*a* with similar external size specifications mounted in chute 61*a*. The key-coded projections on print cartridge 60 are different from the key-coded projections on print cartridge 60*a* to prevent using the print cartridges in the wrong chutes.

The print cartridge 60 includes left and right flex ribbon circuits 86, 88, and encoder flex 90, while print cartridge 60*a* includes similar flex components 86*a*, 88*a*, and 90*a* for providing communication through end terminals 92, 94, 92*a*, 94*a* which are attachable to a printed circuit board (not shown) on the printer.

Figure 4:
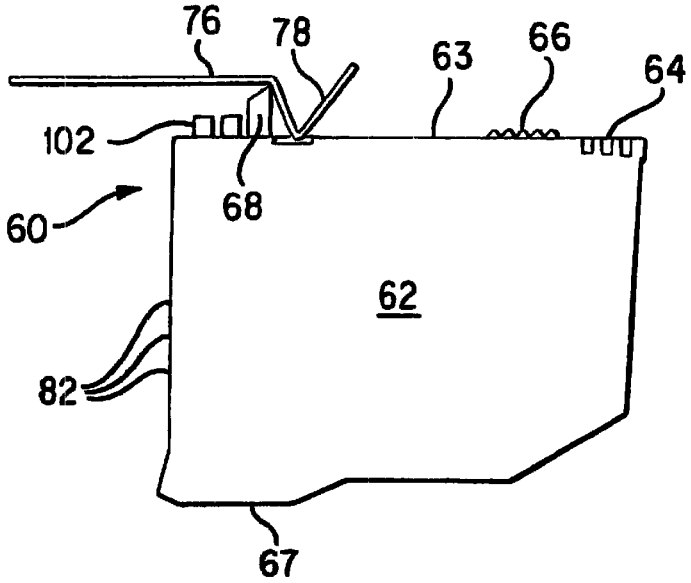
FIG. 4 is a side view schematic showing the print cartridge of FIG. 3A with a biasing carriage spring engaging a print cartridge latch.
Figure 3B:
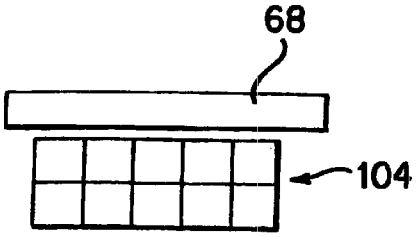
FIG. 3B is a top view schematic showing the five column implementation of FIG. 3A using two rows of separate contiguous blocks.
Figure 3A:
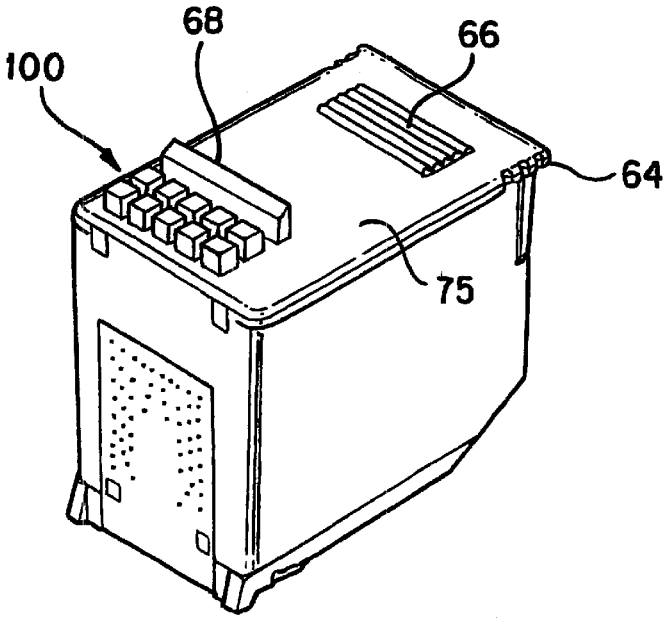
FIG. 3A is a perspective view of a print cartridge having a five column implementation of an embodiment of the invention using a key matrix formed with two rows of separate spaced-apart blocks.
Figure 5:
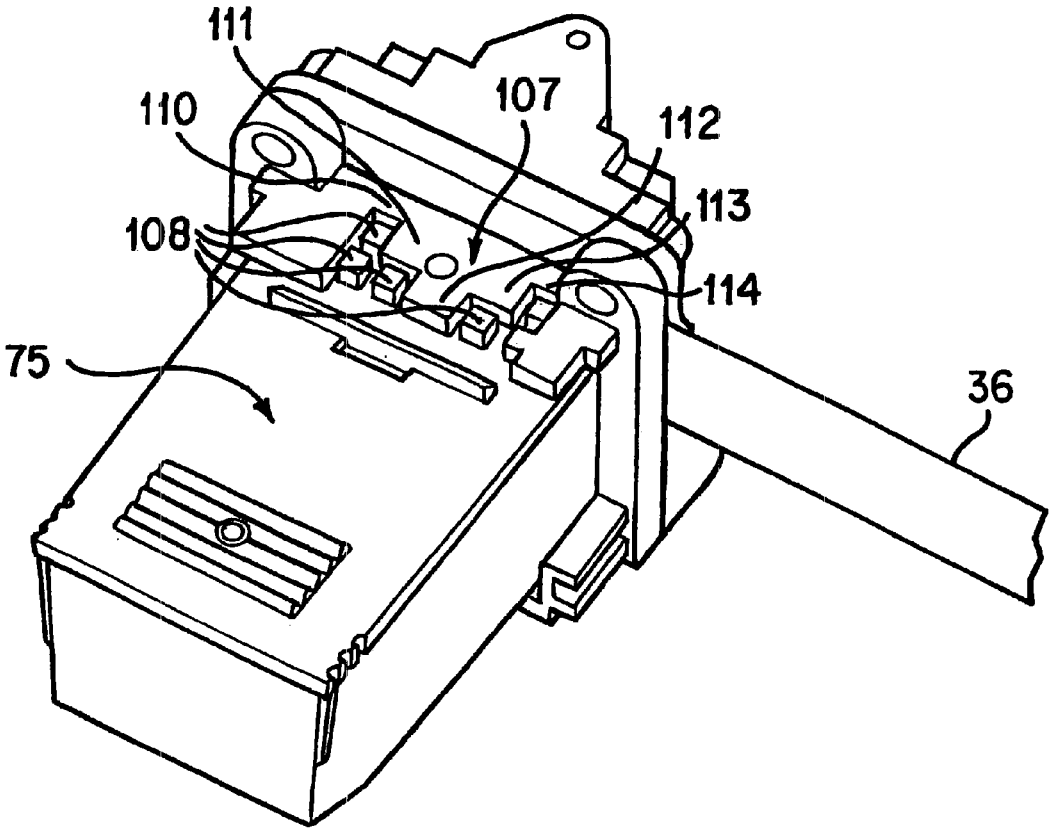
FIG. 5 is a perspective view of the print cartridge of FIG. 3A mounted on a single chute carriage having a matching carriage key matrix formed with an exposed integral five column plate, without showing the biasing carriage spring.

One implementation of the key-coded projections on a print cartridge is shown in FIGS. 3A, 4 and 5 which show a five column two row matrix 100 extending across the entire front portion of the cap in front of the latch. While FIG. 3A shows blocks 102 spaced apart from blocks in adjacent rows and columns, a variation is shown in FIG. 3B with adjacent blocks 104 being contiguous. However the spaced apart block implementation makes it easier to create an encoded key pattern on a manufacturing line by selectively removing certain blocks without causing any damage to those blocks which remain to form the matrix pattern. When mounted in a compatible carriage chute 106 (see FIG. 6), a matching continuous edge matrix key 107 with some remaining blocks such as 108 and some blocks removed creates no lockout interference between any of the five aligned columns 110, 111, 112, 113, 114. It will be understood from FIG. 5 by those skilled in the art that all disclosures, descriptions and variations recited for key-coded patterns on a print cartridge are equally applicable to matrix patterns on a carriage chute. Conversely all disclosures, descriptions and variations recited for key-coded patterns on a carriage are equally applicable to print cartridge matrices.

Figure 6:
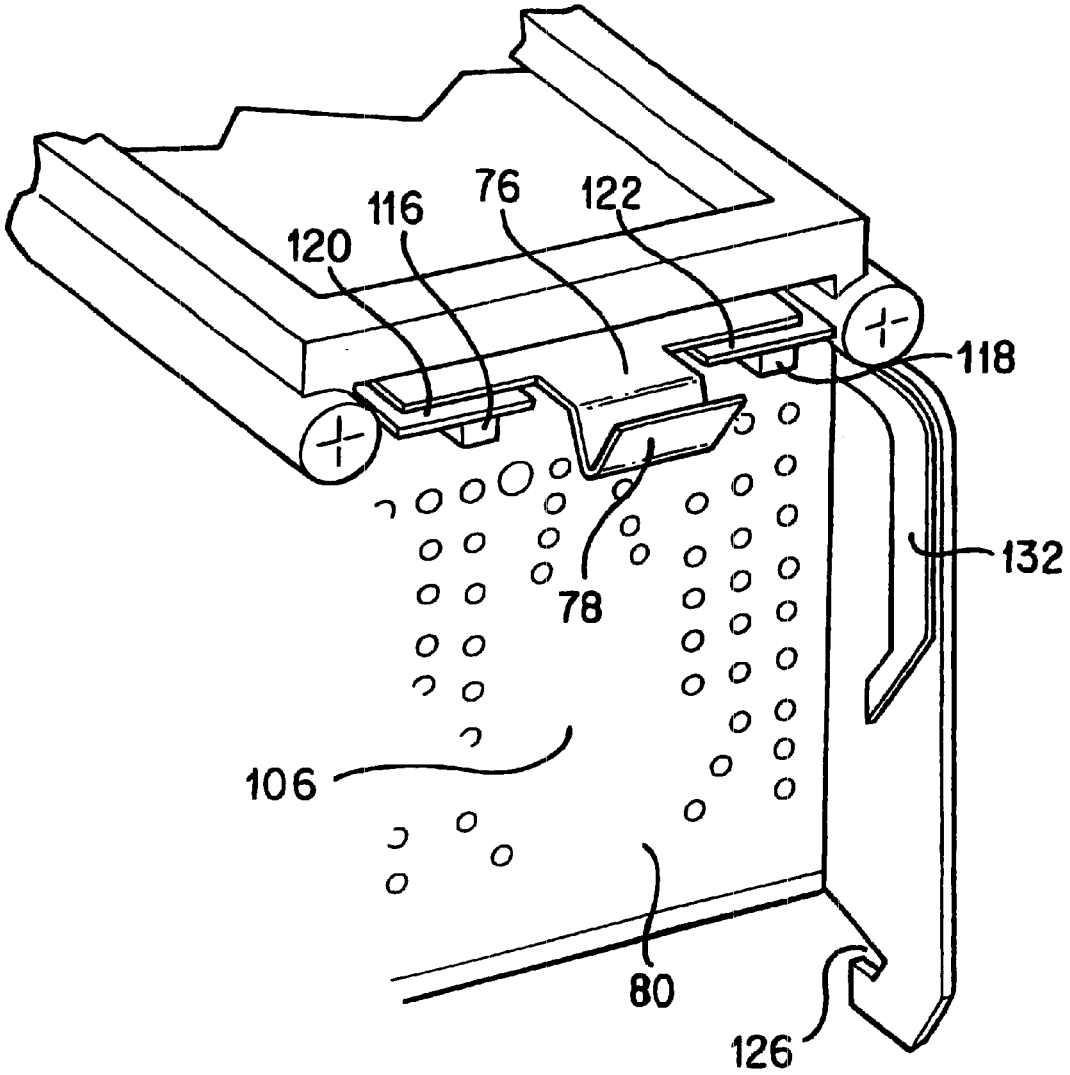
FIG. 6 is a fragmentary/perspective view of an embodiment of an empty single chute carriage having a covered carriage key matrix, and showing the biasing carriage spring.
Figure 7:
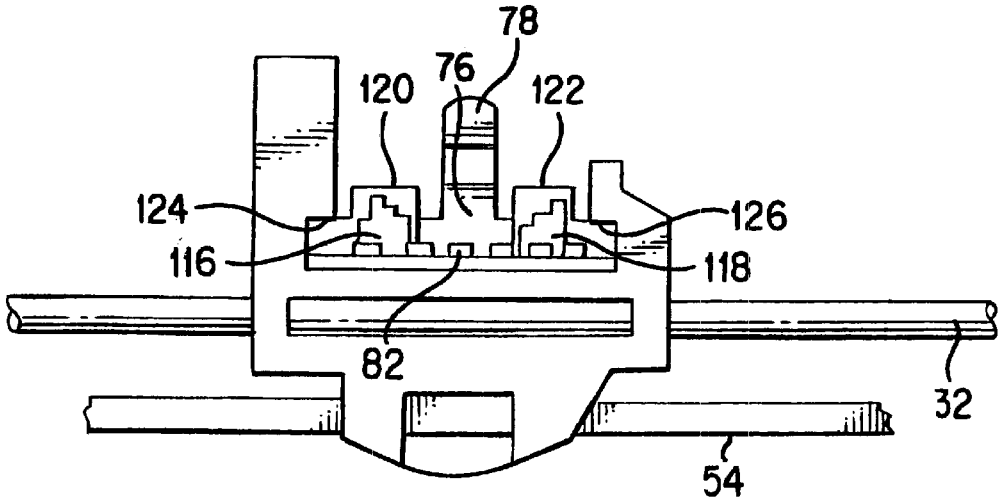
FIG. 7 is a bottom view of the empty single chute of FIG. 6.

FIGS. 6 and 7 show more details of a preferred embodiment of a carriage chute key-coded pattern with the print cartridge removed. The pair of continuous edge patterns 116, 118 are located under protective plates 120, 122. The datum notches 124, 126 at a lower end of the chute are provided to capture pivot legs 128, 130 on a print cartridge, and a side-biasing spring 132 helps to secure the print cartridge. It is important to note that while lockout combinations of print cartridge and carriage key matrices allow both initial engagement of the side-biasing spring 132 with a print cartridge and the capturing of pivot legs by the datum notches, it is not until the V-shaped end of the metal biasing spring reaches its closed position against the latch on the print cartridge cap that a print cartridge achieves stable completed mounting and full conductive contact of the interconnects. The encoded key patterns are located so that such closed position of the metal biasing spring is prevented by abutting contact of aligned columns of non-compatible print cartridges and carriage chutes.

Figure 8:
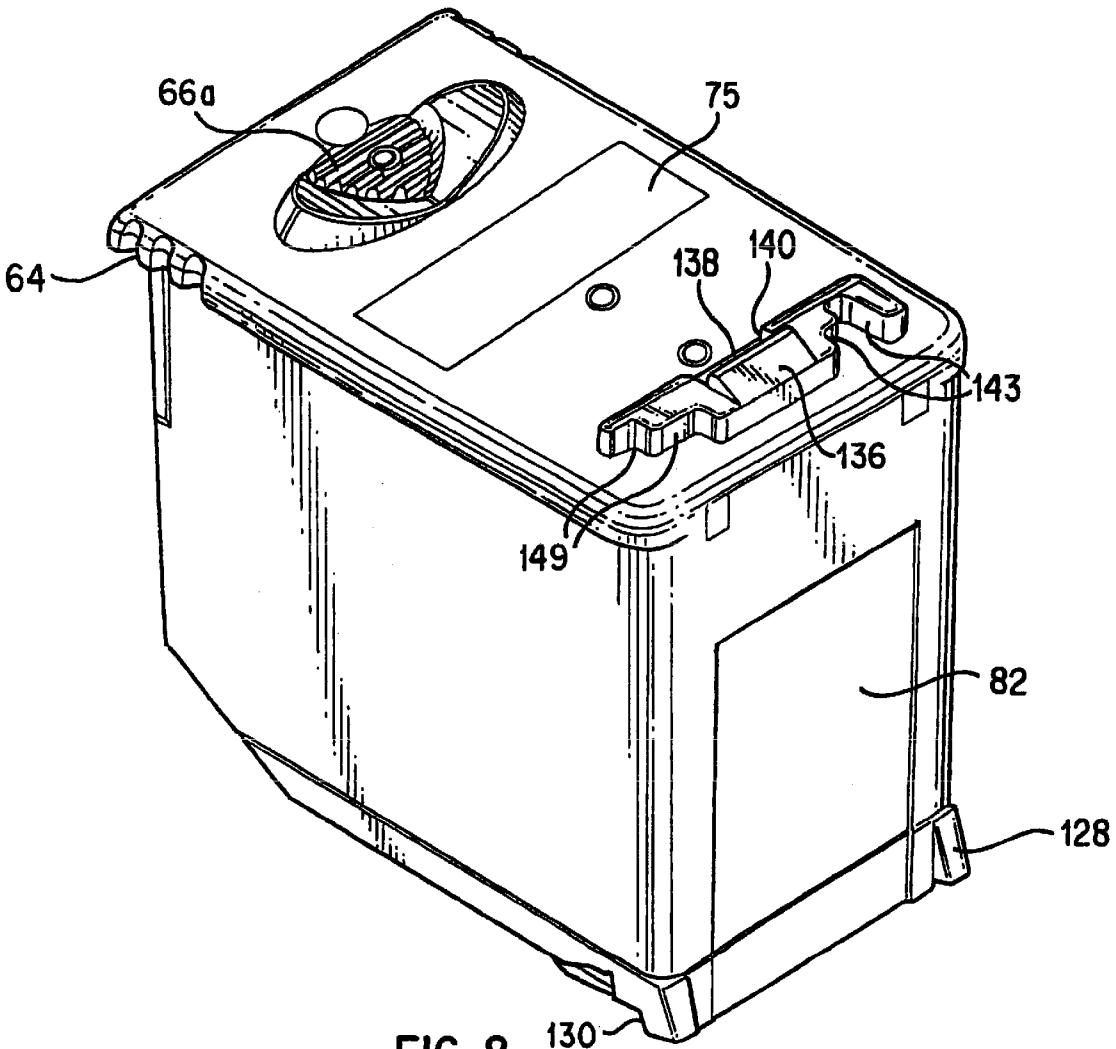
FIG. 8 is a perspective view of an embodiment of a print cartridge having an eight column implementation of the invention using a low profile key matrix formed on both sides of a print cartridge latch.
Figure 9:
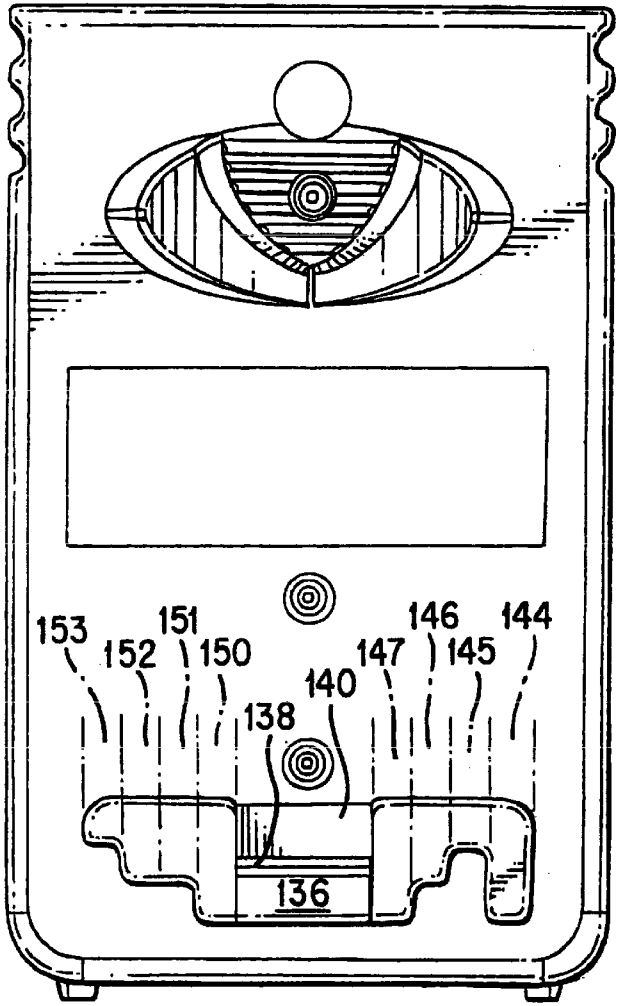
FIG. 9 is a top plan view of the print cartridge of FIG. 8.
Figure 11A:
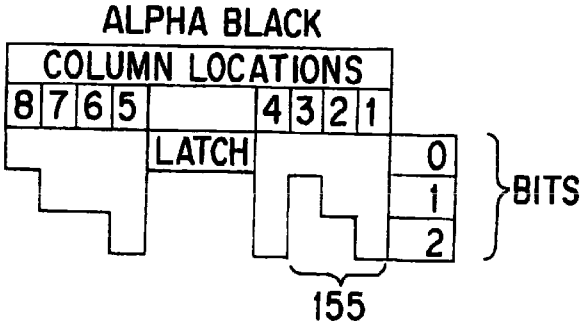
FIGS. 11A–11F are schematic representations of exemplary print cartridge key patterns which respectively identify different print cartridge families.
Figure 11B:
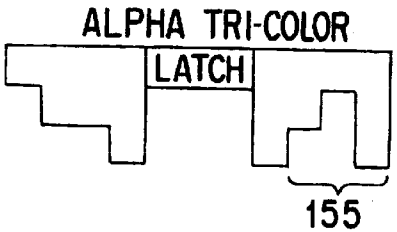
Figure 11C:
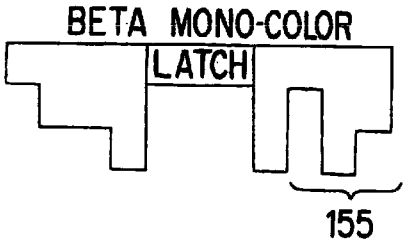
Figure 11D:
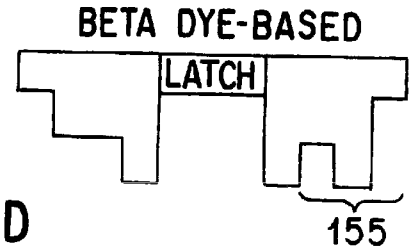
Figure 11E:
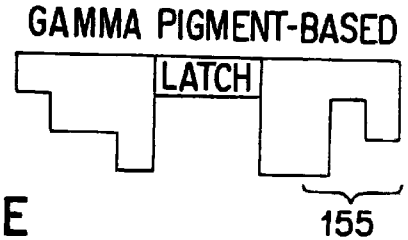
Figure 11F:
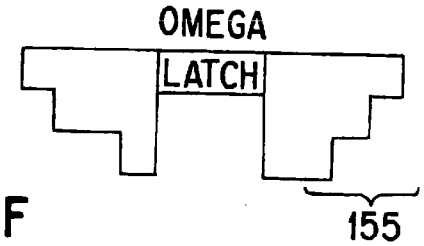

FIGS. 8 and 9 show a presently preferred embodiment of a cap portion of a print cartridge with finger shaped grooves 66*a*, and with a narrow centrally located latch having a beveled face 136 which raises the V-shaped end of the biasing spring upon initial engagement, an apex 138, and a recess 140 for receiving the V-shaped end in the absence of any lockout preventing completion of the mounting procedure. A separate key-coded projection 142 on one side of the latch has continuous edge 143 defined by four columns 144, 145, 146, 147 while another separate key-coded projection 148 on the opposite side of the latch has continuous edge 149 defined by four additional columns 150, 151, 152, 153. The different lengths of the various columns are shown in the following table:

TABLE 1

| Column # | 144 | 145 | 146 | 147 | 150 | 151 | 152 | 153 |
|---|---|---|---|---|---|---|---|---|
| Bit Position | 3rd | 1st | 2nd | 3rd | 3rd | 2nd | 2nd | 1st |

Figure 10A:
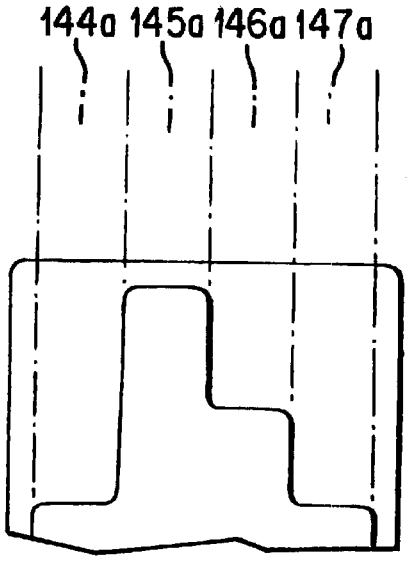
FIGS. 10A and 10B are schematic views looking up at two integral four column plates which together form a covered carriage key matrix having predetermined edge contours which match the low profile key matrix on the print cartridge of FIGS. 8 and 9.

FIGS. 11A–11F show a presently preferred implementation of columns 144, 145 and 145 as shown by bracketed portion 155 for encoding different patterns of column lengths to identify each family of print cartridges. Of course the inverse bit positions for each column will provide the matching patterns, respectively, for all of the compatible printer carriages/chutes (see columns 144*a*, 145*a* and 146*a* in FIG. 10A) The pattern for FIG. 11B identifies the family of print cartridges shown in FIGS. 8 and 9.

Figure 10B:
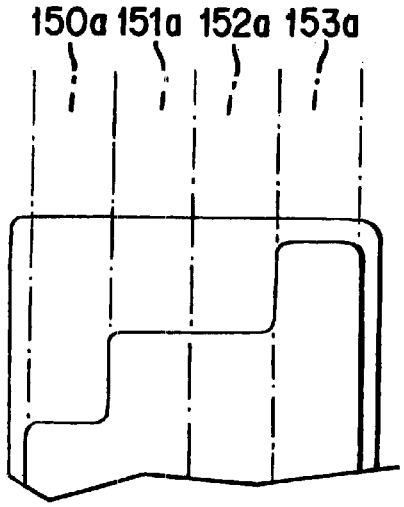

FIGS. 12A–12F show a presently preferred implementation of columns 147, 150, 151, 152 and 153 as shown by bracketed portion 157 for encoding different patterns of column lengths to identify a particular print cartridge within a single family. Such different matrix patterns on print cartridges provide a unique mechanical identification for different carriage configurations. Of course the inverse bit positions for each column will again provide the matching patterns, respectively, for all of the compatible printer carriages/chutes (see columns 147*a*, 150*a*, 151*a*, 152*a* and 153*a* in FIGS. 10A and 10B). The pattern for 12A identifies the particular print cartridge shown in FIGS. 8 and 9.

Figure 12A:
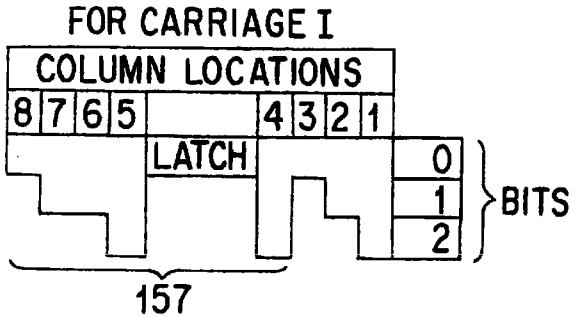
FIGS. 12A–12F are schematic representations of exemplary print cartridge key patterns of the single print cartridge family of FIG. 11A, with each key pattern being sufficiently different to be uniquely compatible with a particular printer carriage configuration.
Figure 12B:
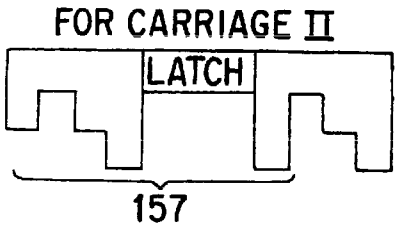
Figure 12C:
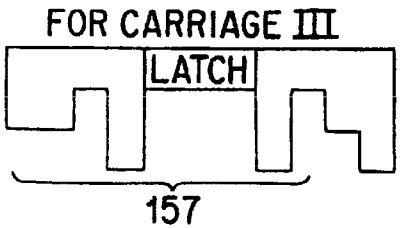
Figure 12D:
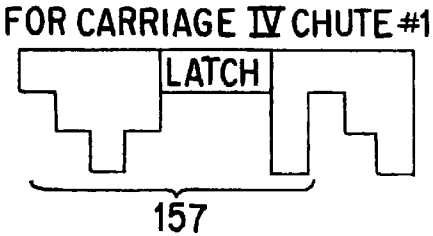
Figure 12E:
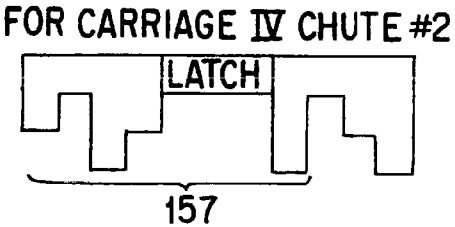
Figure 12F:
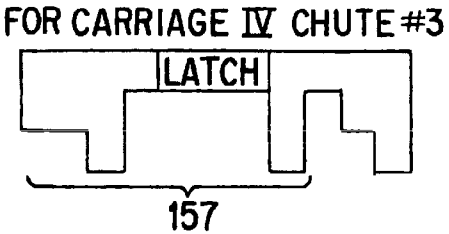

Comparative analysis of the matrix patterns of column locations 4 to 8 in FIGS. 12A–12F illustrate the technique of having at least one column in a key matrix of a first print cartridge longer than a corresponding column in a key matrix of a second print cartridge. Thus when considering the pattern in FIG. 12A shaped to match a key pattern of Carriage I, it is noted that lockout occurs because column #8 in FIGS. 12B, 12C, 12E and 12F is longer than column #8 in FIG. 12A, and because column #6 in FIGS. 12D, 12E, and 12F is longer than column #6 in FIG. 12A.

Figure 13:
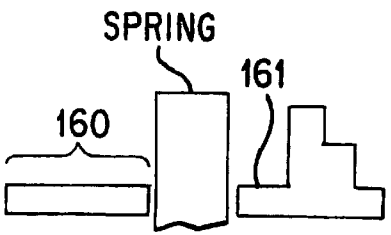
FIG. 13 is a schematic representation of an exemplary universal carriage key matrix capable of matchup with all print cartridge key patterns of the print cartridge family of FIGS. 12A–12F.
Figure 15:
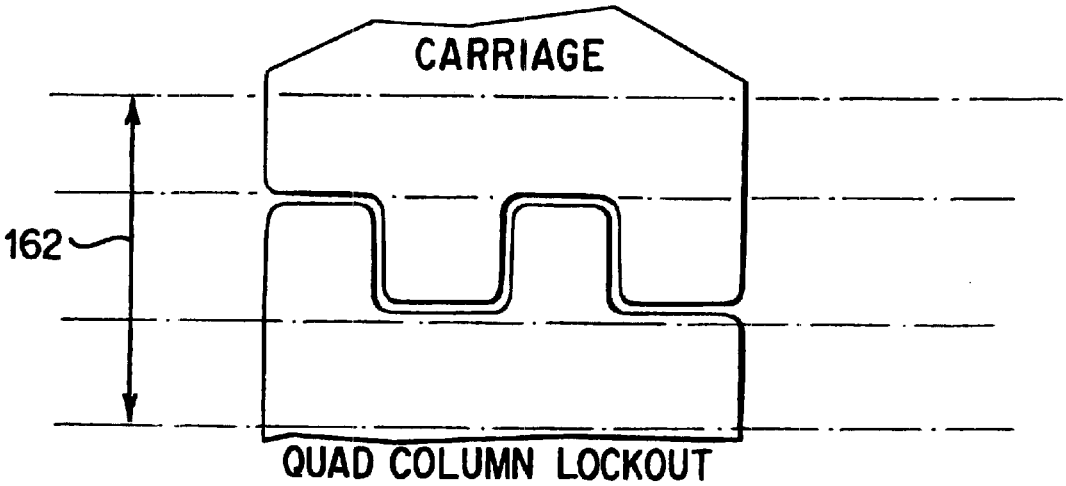
FIGS. 15–19 schematically show various lockout combinations of a four column key matrix pattern which occur when a print cartridge is inserted into a non-compatible printer carriage.
Figure 14:
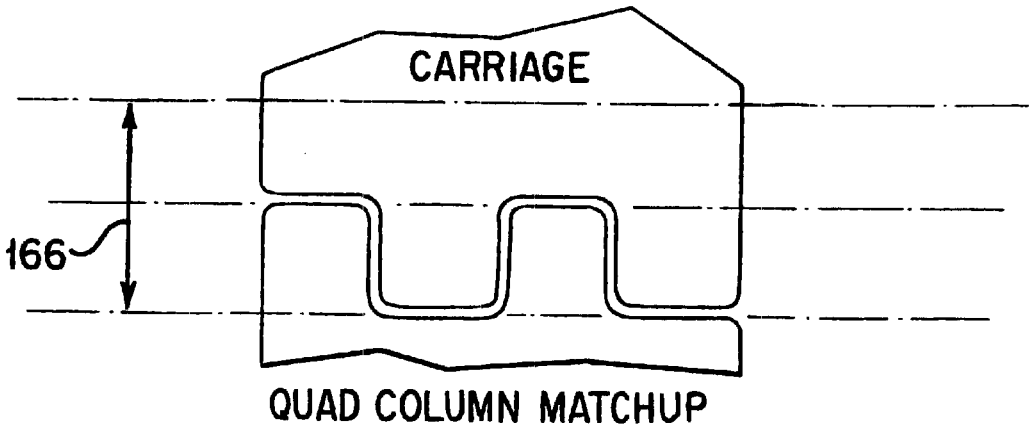
FIG. 14 schematically shows a four column matchup of key matrix patterns.
Figure 16:
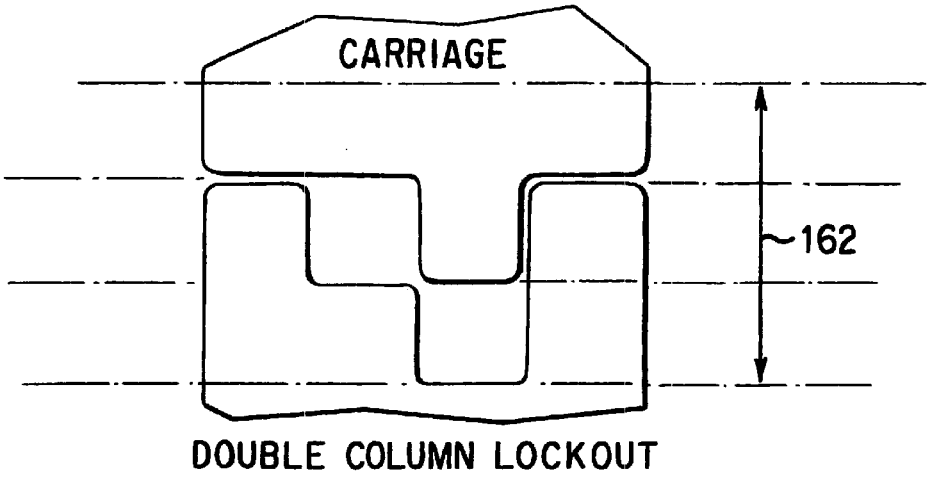
Figure 17:
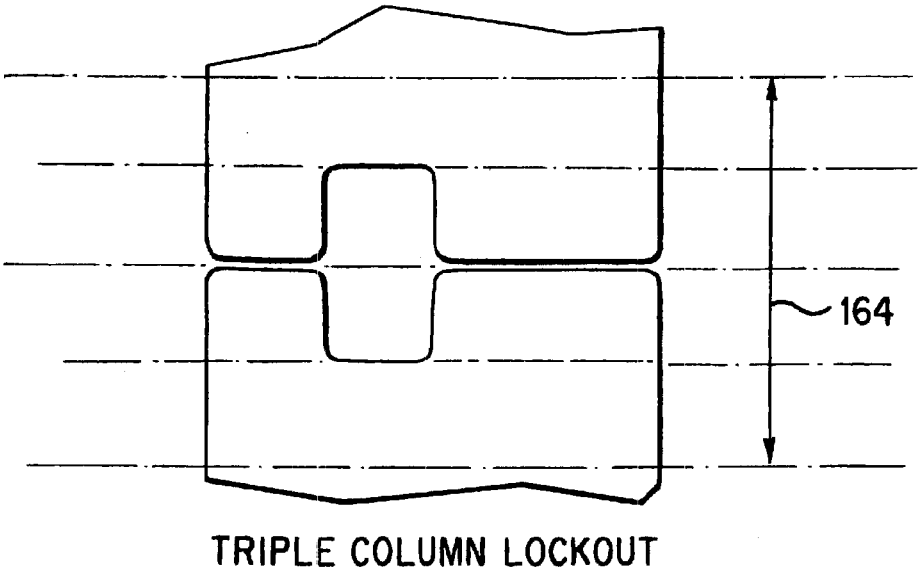
Figure 18:
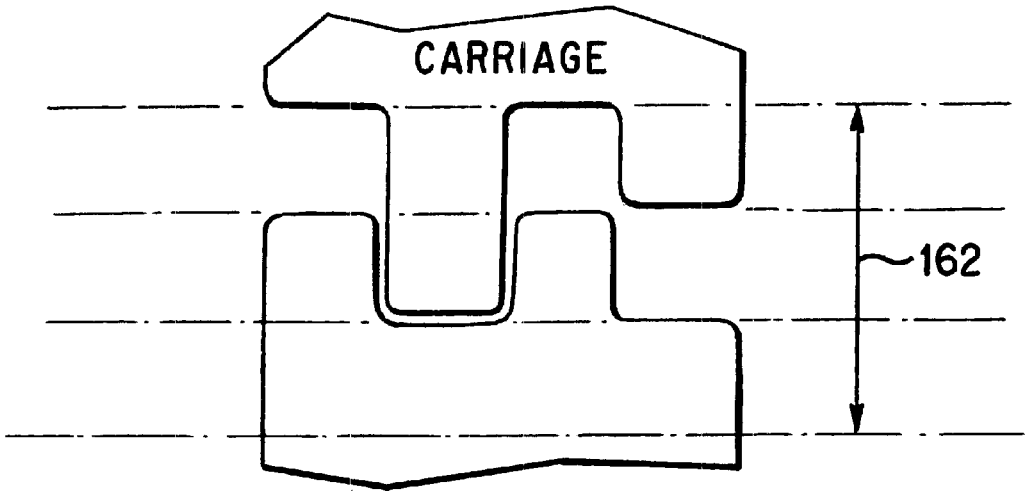
Figure 19:
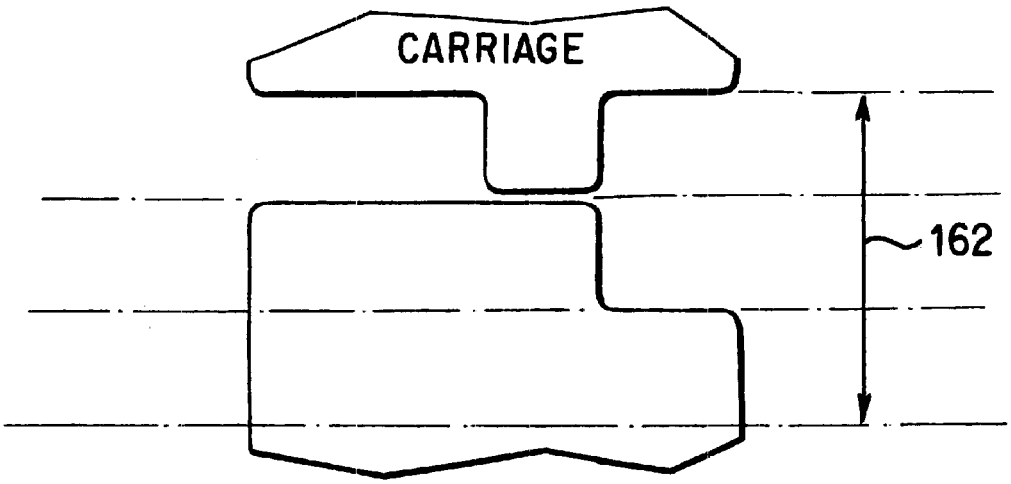
Figure 20A:
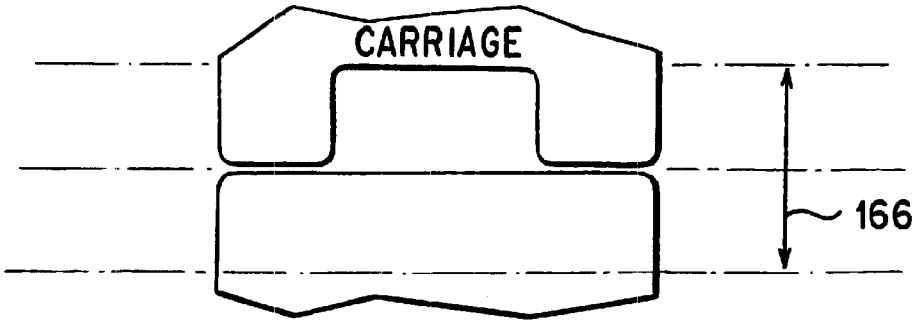
FIGS. 20A–20C schematically show a hybrid print cartridge key matrix capable of matchup with a subset of different carriage key patterns.
Figure 20B:
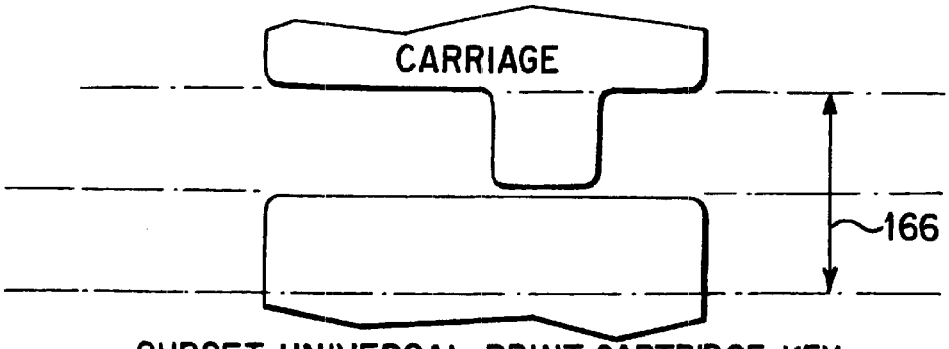
Figure 20C:
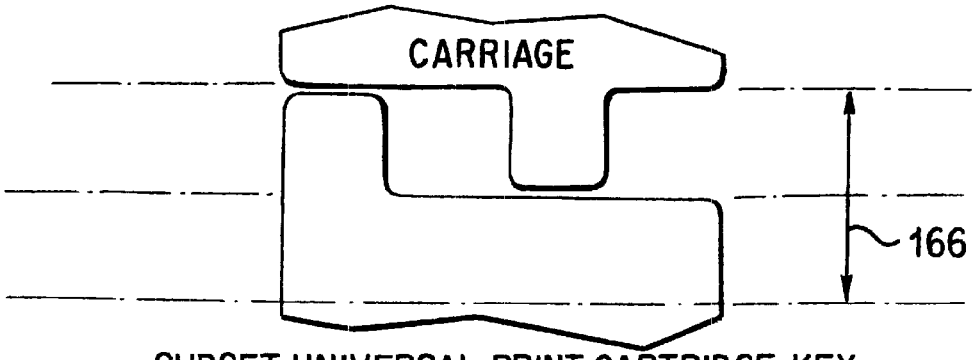
Figure 21A:
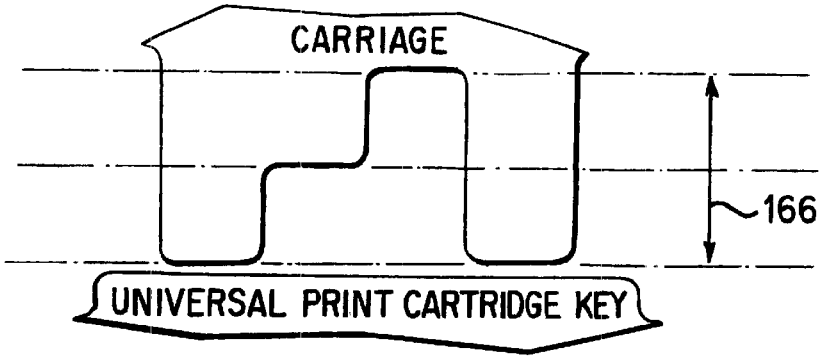
FIGS. 21A and 21B schematically show a exemplary universal key matrix for a print cartridge capable of matchup with all carriage key patterns.
Figure 21B:
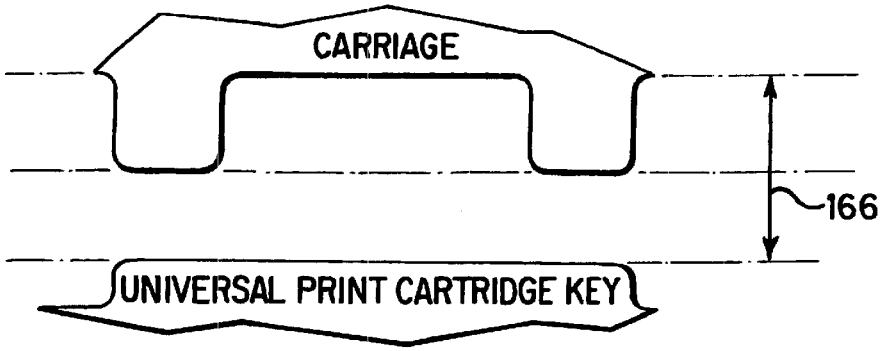

FIG. 13 shows a pattern of completely truncated columns at 160, 161 in order to provide a universal carriage key for receiving all print cartridges of the family exemplified in FIGS. 12A–12F. A similar complete truncation of columns on a print cartridge creates a universal printhead key (see FIGS. 21A and 21B) for installation on all carriages without causing any lockout.

FIGS. 15–19 show examples of lockout when the overall length of aligned columns is three bit lengths 162 or four bit lengths 164 which both exceed the maximum of two bit lengths for matching compatibility.

FIGS. 14, 20A–20C, and 21A–21B all show examples of compatibility when the overall length of aligned columns is not more than two bit lengths 166. By completely truncating all of the columns (FIGS. 21A–21B), none of the corresponding columns on any carriage are individually long enough to cause a lockout. When columns are partially truncated (FIGS. 20A–20C), some universality is achieved where all corresponding columns on various carriages have a length of one bit or less. This provides a way to prevent lockout of certain types of print cartridges having widespread use in many different printer carriages/chutes.

Figure 22:
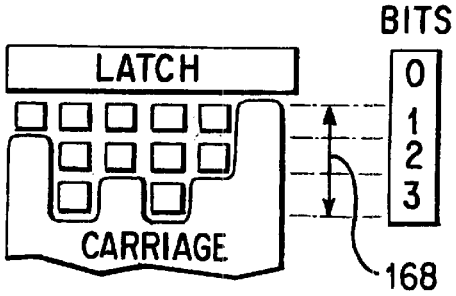
FIGS. 22 schematically shows a six column matchup of key matrix patterns.
Figure 23:
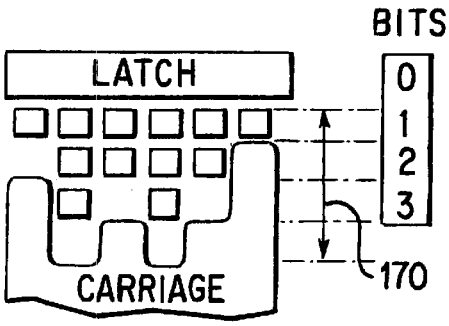
FIGS. 23 schematically shows a possible lockout combination of the six column key matrix patterns of FIG. 22 when a print cartridge is inserted into a non-compatible printer carriage.

Finally, it will be understood upon reference to FIGS. 22–23 that the invention is applicable to virtually all combinations of column/row sizes depending on the available space on a print cartridge. In that regard, FIGS. 22–23 show a six column/four bit matrix using separate blocks to define the columns. Where the overall length of aligned columns is not more than three bit lengths 168, then compatible matchup occurs. When the overall length of aligned columns is four bit lengths 170, then lockout occurs since the maximum of three bit lengths has been exceeded.

There are other ways to define column lengths in order to implement the present invention. For example a first bit position could be a slot, a second bit position a flat, and a third bit position a nub. If there is a need for more easily configured keys, a tab break-off design or machinable tab could be used such that a first bit position is "no tabs", a second bit position is "one tab" (or ½ height tab), and a third bit position is "two tabs" height tab).

The following table shows how the combination that yields the maximum number of unique keys is selected for a five position three bit embodiment.

TABLE II

| Total Number of Positions (n) | Number of Slots (r) | Number of Slot Configurations (nCr) | Remaining Positions (p) | Number of Knubs (x) 0 | 1 | 2 | 3 | 4 | 5 |
|---|---|---|---|---|---|---|---|---|---|
| | | | | Number of Key Configurations with Slots & Knubs (nCr × pCx) | | | | | |
| 5 | 0 | 1 | 5 | 1 | 5 | 10 | 10 | 5 | 1 |
| | 1 | 5 | 4 | 5 | 20 | 30 | 20 | 5 | — |
| | 2 | 10 | 3 | 10 | 30 | 30 | 10 | — | — |
| | 3 | 10 | 2 | 10 | 20 | 10 | — | — | — |
| | 4 | 5 | 1 | 5 | 5 | — | — | — | — |
| | 5 | 1 | 0 | 1 | — | — | — | — | — |

As shown in table II a scheme of "two nubs/two slots/one flat" or "two nub/one slot/two flats" or "one nub/two slots/two flats" each yield 30 unique combinations. Even though it appears that adding these combinations will increase the total number of configurations, some of them do not create the desired uniqueness required for lockout.

Therefore although adding together the combinations of slot configurations will give us the theoretical maximum, the keys without the nubs will fit in the carriage designed to accept the keys, hence making them unusable as unique keys.

It is to be understood that the specific embodiments disclosed are by way of example only, and those skilled in the art will appreciate if various changes, improvements and modifications can be made to the examples given without departing from the spirit and cope of the invention as set forth in the following claims.

We claim as our invention:

1. A carriage assembly for holding one or more inkjet print cartridges mounted thereon, each of said one or more print cartridges including a nozzle array located on a print cartridge surface for ejecting ink drops during printing operations, the carriage assembly comprising:

a frame;

a support member on said frame;

a chute carried on said support member for holding the one or more print cartridges;

an electrical interconnect on said chute for coupling to said one or more print cartridges in order to selectively activate each of said nozzle arrays on said one or more print cartridges to eject the ink drops;

a biasing member on said chute for holding said one or more print cartridges in a secure mounted printing position; and a mechanical key on said chute formed into a predetermined pattern having a plurality of columns with each column capable of defining one or more multiple bit positions such that at least one of said columns acts as a barrier preventing a non-compatible print cartridge from staying in the secure mounted printing position, wherein at least one column has multiple bit positions.

2. The carriage assembly of claim 1 which includes at least two chutes for respectively holding two print cartridges.

3. The carriage assembly of claim 1 wherein said mechanical key includes a predetermined pattern having at least one column capable of defining at least three different bit positions.

4. The carriage assembly of claim 1 wherein said mechanical key includes a predetermined pattern having a plurality of columns with each column capable of defining at least three different bit positions.

5. The carriage assembly of claim 1 wherein said plurality of columns includes three or more columns.

6. The carriage assembly of claim 1 wherein said plurality of columns respectively include fixed ends at a default position and variable ends, and wherein said mechanical key is formed in a predetermined pattern defined by a boundary line along said variable ends.

7. The carriage assembly of claim 6 wherein said boundary line is formed by a continuous raised edge.

8. The carriage assembly of claim 1 wherein at least one of said columns acts as a barrier preventing the print cartridge from being mounted in said printing position in a non-compatible chute of a printer carriage.

9. The carriage assembly of claim 1 wherein at least two of said columns act as a barrier preventing the print cartridge from being mounted in said printing position in a non-compatible chute of a printer carriage.

10. The carriage assembly of claim 1 which further includes a platen for holding media passing through a print zone, and a mechanism for moving said carriage assembly back and forth over said platen.

11. The method of claim 1 wherein a supply of liquid ink is provided to the print cartridge.

12. The carriage assembly of claim 1, further including a mechanism for moving the carriage assembly back and forth along a carriage axis.

13. The carriage assembly of claim 1 wherein the biasing member includes a biasing spring positioned on said chute to contact a latch formed on a cap surface of the print cartridge.

14. A printer including the carriage assembly of claim 1, and further including a mechanism for moving the carriage assembly back and forth along a carriage axis.

15. A carriage assembly for holding one or more inkjet print cartridges mounted thereon, comprising:

a frame;

a support member on said frame;

a chute carried on said support member for holding the one or more print cartridges;

an electrical interconnect on said chute for coupling to said one or more print cartridges in order to selectively activate said print cartridges to eject ink;

a biasing member on said chute for holding said one or more print cartridges in a secure mounted printing position; and a mechanical key on said chute formed into a predetermined pattern having a plurality of columns with each column capable of defining one or more multiple bit positions such that at least one of said columns acts as a barrier preventing a non-compatible print cartridge from staying in the secure mounted printing position, said plurality of columns including four or more columns, wherein at least one column has multiple bit positions.

16. A carriage assembly for holding one or more inkjet print cartridges mounted thereon, comprising:

a frame;

a support member on said frame;

a chute carried on said support member for holding the one or more print cartridges;

an electrical interconnect on said chute for coupling to said one or more print cartridges in order to selectively activate said print cartridges to eject ink drops from a print cartridge nozzle array onto a print medium;

a biasing member on said chute for holding said one or more print cartridges in a secure mounted printing position; and a mechanical key on said chute formed into a predetermined pattern having a plurality of columns with each column capable of defining one or more multiple bit positions such that at least one of said columns acts as a barrier preventing a non-compatible print cartridge from staying in the secure mounted printing position, said plurality of columns respectively including fixed ends at a default position and variable ends, wherein at least one column has multiple bit positions, and wherein said mechanical key is formed in a predetermined pattern defined by a boundary line along said variable ends, and boundary line is formed by a continuous raised edge.

17. A carriage assembly for holding one or more inkjet print cartridges mounted thereon, comprising:

a frame;

a support member on said frame;

a chute carried on said support member for holding the one or more print cartridges;

an electrical interconnect on said chute for coupling to said one or more print cartridges in order to selectively activate said print cartridges to eject ink;

a biasing member on said chute for holding said one or more print cartridges in a secure mounted printing position; and a mechanical key on said chute formed into a predetermined pattern having a plurality of columns with each column capable of defining one or more multiple bit positions such that at least one of said columns acts as a barrier preventing a non-compatible print cartridge from staying in the secure mounted printing position, wherein at least one column has multiple bit positions, and said mechanical key covered by a protective plate to facilitate proper alignment between columns of the print cartridge and the carriage assembly.

18. A movable carriage assembly holding one or more inkjet print cartridges mounted thereon, each having a printhead mounted thereon, the carriage assembly comprising:

a chute structure holding the one or more print cartridges;

a support structure connected to the chute structure for sliding engagement on a printer support rod;

an electrical interconnect on said chute structure for coupling to said one or more print cartridges to selectively activate said print cartridges to eject ink;

a mechanical key on said chute formed into a predetermined pattern having a frugal plurality of columns with each column capable of defining one or more multiple bit positions such that at least one of said columns acts as a barrier preventing a non-compatible print cartridge from staying in a secure mounted printing position, wherein at least one column has multiple bit positions.

19. A carriage assembly for holding one or more -inkjet print cartridges mounted thereon, comprising:

a frame;

a support member on said frame;

a chute carried on said support member for holding the one or more print cartridges;

an electrical interconnect on said chute for coupling to said one or more print cartridges in order to selectively activate said print cartridges to eject ink;

a biasing member on said chute for holding said one or more print cartridges in a secure mounted printing position; and a mechanical key on said chute formed into a predetermined pattern having a plurality of columns with each column capable of defining one or more multiple bit positions such that at least one of said columns acts as a barrier preventing a non-compatible print cartridge from staying in the secure mounted printing position, said plurality of columns including four or more columns, wherein at least one column has multiple bit positions.

20. A carriage assembly for holding one or more inkjet print cartridges mounted thereon, comprising:

a frame;

a support member on said frame;

a chute carried on said support member for holding the one or more print cartridges;

an electrical interconnect on said chute for coupling to said one or more print cartridges in order to selectively activate said print cartridges to eject ink; a biasing member on said chute for holding said one or more print cartridges in a secure mounted printing position; and a mechanical key on said chute formed into a predetermined pattern having a plurality of columns with each column capable of defining one or more multiple bit positions such that at least one of said columns acts as a barrier preventing a non-compatible print cartridge from staying in the secure mounted printing position, wherein at least one column has multiple bit positions, and said mechanical key on said chute is covered by a protective plate to facilitate proper alignment between columns of the print cartridge and the carriage assembly.

21. A carriage assembly for holding one or more inkjet print cartridges mounted thereon, the carriage assembly comprising:

a frame;

a bushing on the frame for engaging a support bar for sliding movement of the carriage assembly on the support bar;

a support member on said frame;

a chute carried on said support member for holding the one or more print cartridges;

an electrical interconnect on said chute for coupling to said one or more print cartridges in order to selectively activate said one or more print cartridges to eject ink drops onto a print media during printing operations;

a biasing member on said chute for holding said one or more print cartridges in a secure mounted printing position; and a mechanical key on said chute formed into a predetermined pattern having a plurality of columns with each column capable of defining one or more multiple bit positions such that at least one of said columns acts as a barrier preventing a non-compatible print cartridge from staying in the secure mounted position, wherein at least one column has multiple bit positions.

* * * * *